US006373362B1

(12) United States Patent
Kim

(10) Patent No.: US 6,373,362 B1
(45) Date of Patent: Apr. 16, 2002

(54) SIGNAL CONVERTER

(75) Inventor: Nak Hyun Kim, Seoul (KR)

(73) Assignee: Sambu Communics Co., Ltd., Seoul (KR)

( * ) Notice: Subject to any disclaimer, the term of this patent is extended or adjusted under 35 U.S.C. 154(b) by 0 days.

(21) Appl. No.: 09/732,776

(22) Filed: Dec. 11, 2000

(30) Foreign Application Priority Data

Sep. 4, 2000 (KR) ..... 2000-51955

(51) Int. Cl.[7] ..... H01F 7/08; H04R 1/00; H04R 11/02; H04R 9/06

(52) U.S. Cl. ..... 335/222; 381/421

(58) Field of Search ..... 335/222, 223; 381/396–422

(56) References Cited

U.S. PATENT DOCUMENTS 4,412,317 A * 10/1983 Asjes et al. ..... 367/185
5,778,133 A * 7/1998 Plesko ..... 385/146

* cited by examiner

*Primary Examiner*—Ramon M. Barrera
(74) *Attorney, Agent, or Firm*—Bacon & Thomas

(57) ABSTRACT

A signal converter used in various electronic communication products saves power consumption and prolongs the time for usage thereof by its structural characteristics. The signal converter functions as a vibrator, a speaker, and a receiver, etc. together, and generates vibration or sound by magnets installed such that a repulsive force or an attractive force generated from magnets and excitation coils is directed to the same direction so as to remove an inefficient functional operation. The signal converter comprises a frame, a yoke having two protrusions, and a plurality of air throughs formed around the protrusion of the yoke body, the air through penetrating through the yoke body for air flow, two springs installed inside the frame for providing the yoke with elasticity, two magnets provided above and under the yoke respectively with a certain distance away from the protrusions of the yoke, and two excitation coils installed from the diaphragm and the grill above and under the frame to the space between the magnet and the yoke protrusion for generating magnetic force. The two magnets are installed with the different polarity facing each other.

4 Claims, 6 Drawing Sheets

SIGNAL CONVERTER

BACKGROUND OF THE INVENTION

1. Field of the Invention

The present invention relates to a signal converter, and more particularly, to a signal converter functioning as a speaker or a receiver and a vibrator inside an electronic products such as a cellular phone or a personal communication service phone to minimize the power consumption.

2. Description of the Related Art

Generally, a speaker or a buzzer and a vibrator are installed inside a cellular phone, a personal communication service(PCS) phone, a pager, etc. in order to inform the signal arrival via a base station from a sender away. As widely known that an electronic product such as an electronic communication product as above is now in a trend of being minimized in its size, the size of each device installed thereinside also becomes smaller and smaller.

Accordingly, there are provided various kinds of electronic communication products for supplying as many as services with the most minimized size, and they use signal converters being capable of carrying all the functions as a vibrator, a receiver and a speaker together. The signal converter is shaped such that a round-shaped diaphragm and a base are coupled on the upper side and the lower side of a cylindrical-shaped case respectively. Between the case and the diaphragm is extracted out a terminal, which is connected to an excitation coil, and a sound output on the side wall of the case is penetrated through the inside of the case.

A spring, which is installed inside the case by the base pressured from the lower side, is integrally coupled with the extension end of the yoke at its center, and a magnet and a plate are coupled on the upper side of the yoke in turns. An iron core with a certain height is formed at the center of the yoke.

However, the conventional signal converter can vibrate the yoke only when supplying a high current from the outside power to the excitation coil or to the parts except a cut groove connecting the spring center and the outside. In other words, a high driving power is required to drive the signal converter, and as a result, the power consumption is increased.

The applicant of this Invention filed a Patent Application for a low power consumption signal converter applied on Jul. 28, 2000 with the Korean Patent Application No. 43775 by changing the structure of a spring, a yoke, excitation coils, etc. for the signal converter to be capable of sensitively respond to the input from outside. However, since a pair of magnets, plates and excitation coils are used, a driving power should be changed according to the functions. In other words, a high frequency driving power is required when carrying out the function of a speaker or a receiver after carrying out the function of a vibrator so that a high power is still consumed, and a respective function is not satisfied.

Additionally, the signal converter has a disadvantage of low efficiency of power consumption because the generation function of vibration or sound is determined by the current flowing through only any one of the excitation coils attached on the upper side and the lower side of the yoke, and the other remaining excitation coil and its corresponding magnet do not carry their functions in the operation of generating vibration or sound.

SUMMARY OF THE INVENTION

The present invention is directed to provide a signal converter for minimizing power consumption required in generating vibration or sound by installing magnets such that a repulsive force or an attractive force generated from magnets provided above and under a yoke, and excitation coils attached to a vibrator or a grill is directed to the same direction.

Also, the present invention is directed to provide a signal converter for prolonging the time for using a cellular phone or a PCS phone, or a notebook, etc. having the signal converter installed therein by minimizing the power consumption.

To achieve these and other advantages in accordance with the present invention, the signal converter comprises a frame in a cylindrical shape; a yoke configured to be in a round-disk shape and to have two protrusions, each protrusion outwardly extended from the center of the yoke body, and a plurality of air throughs formed around the protrusion of the yoke body, the air through penetrating through the yoke body for air flow; two springs horizontally installed inside the frame for providing the yoke with elasticity; two magnets provided above and under the yoke respectively with a certain distance away from the protrusions of the yoke, the different polarity of the magnets facing each other; and two excitation coils installed from the diaphragm and the grill above and under the frame to the space between the magnet and the yoke protrusion for generating magnetic force for vibration or sound with a supplied driving power of a frequency.

The two excitation coils are connected in parallel or in series, and a driving power is supplied to the both ends of the two excitation coils connected in parallel or in series. A receiving hole is formed at the center of the spring for mounting the yoke, and a plurality of open holes are formed in an arc shape around the receiving hole of the spring for providing elasticity. The spring coupled on the upper side of the yoke is integrally molded with the frame.

The concluding portion of this specification particularly points out and distinctly claims the subject matter of the present invention. However those skilled in the art will best understand both the organization and method of operation of the invention, together with further advantages and objects thereof by reading the remaining portions of the specification in view of the accompanying drawings.

DETAILED DESCRIPTION OF THE INVENTION

Referring to the attached drawings, the description of the operation of a signal converter according to the present invention will be made.

Figure 1:
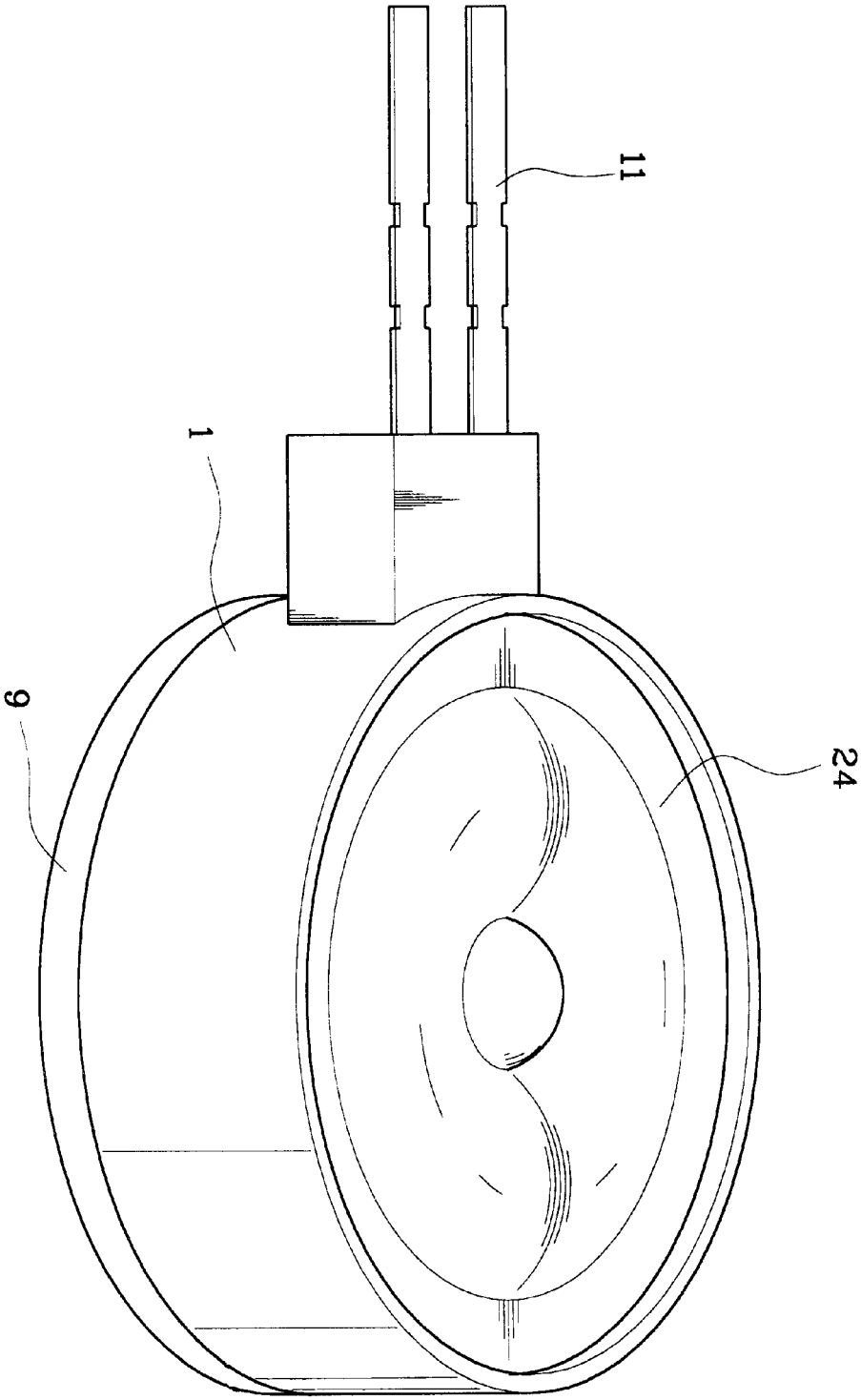
FIG. 1 is a perspective view showing a signal converter according to the present invention.

FIG. 1 is a perspective view of a signal converter according to the present invention. As shown in FIG. 1, the signal converter comprises a cylindrical-shaped frame 1 having a terminal 11 extended from its side wall through a molding member, the terminal connected in parallel or in series to two excitation coils for generating vibration and sound and supplying a driving power(alternating current(AC) or pulse, etc. having a certain frequency); a diaphragm 24 located on the upper side of the frame 1 shaped in double dome and generating sound; and a grill 9 located on the lower side of the frame 1, the grill having a plurality of holes.

Figure 2:
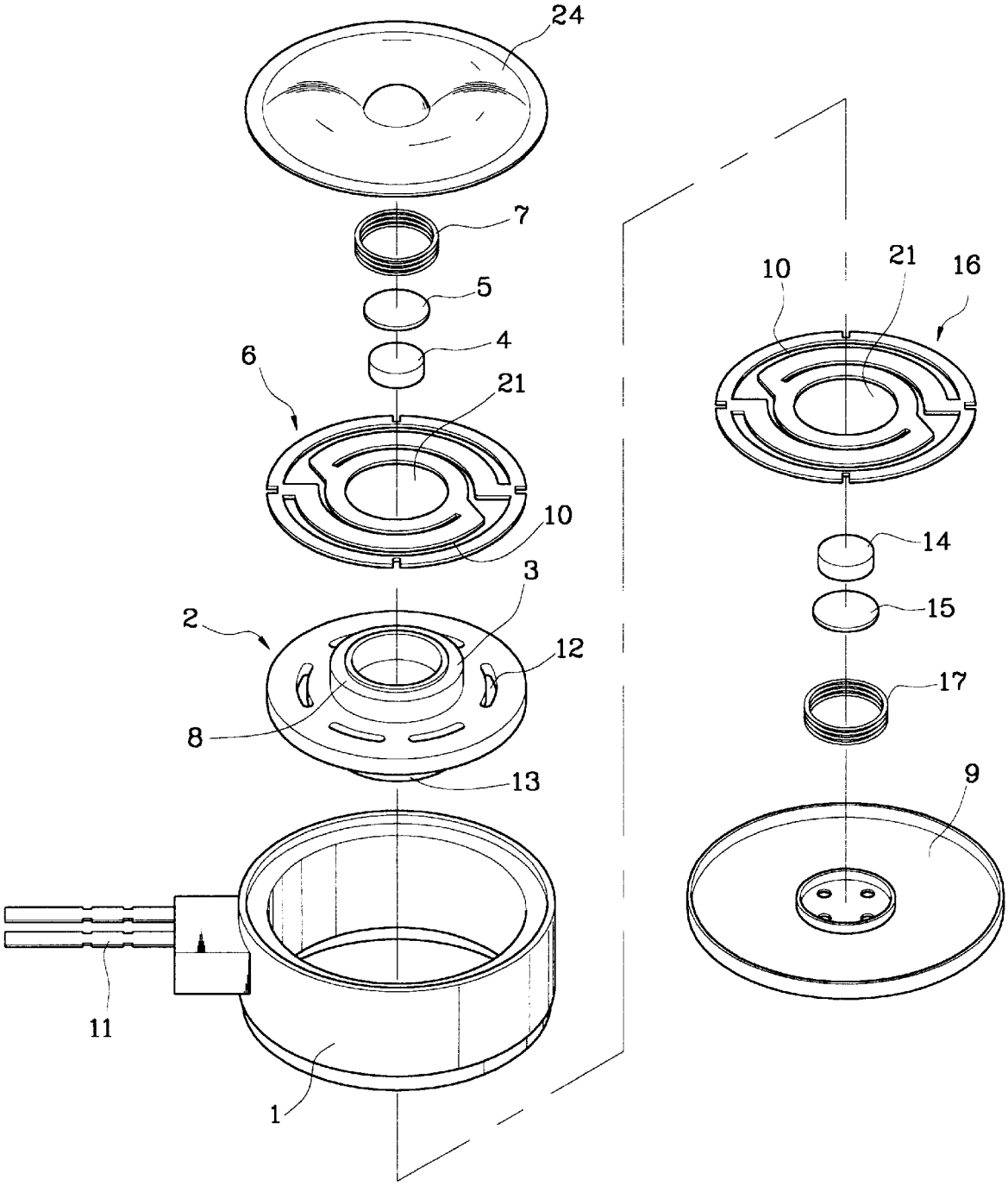
FIG. 2 is an exploded perspective view showing the signal converter according to the present invention.
Figure 3:
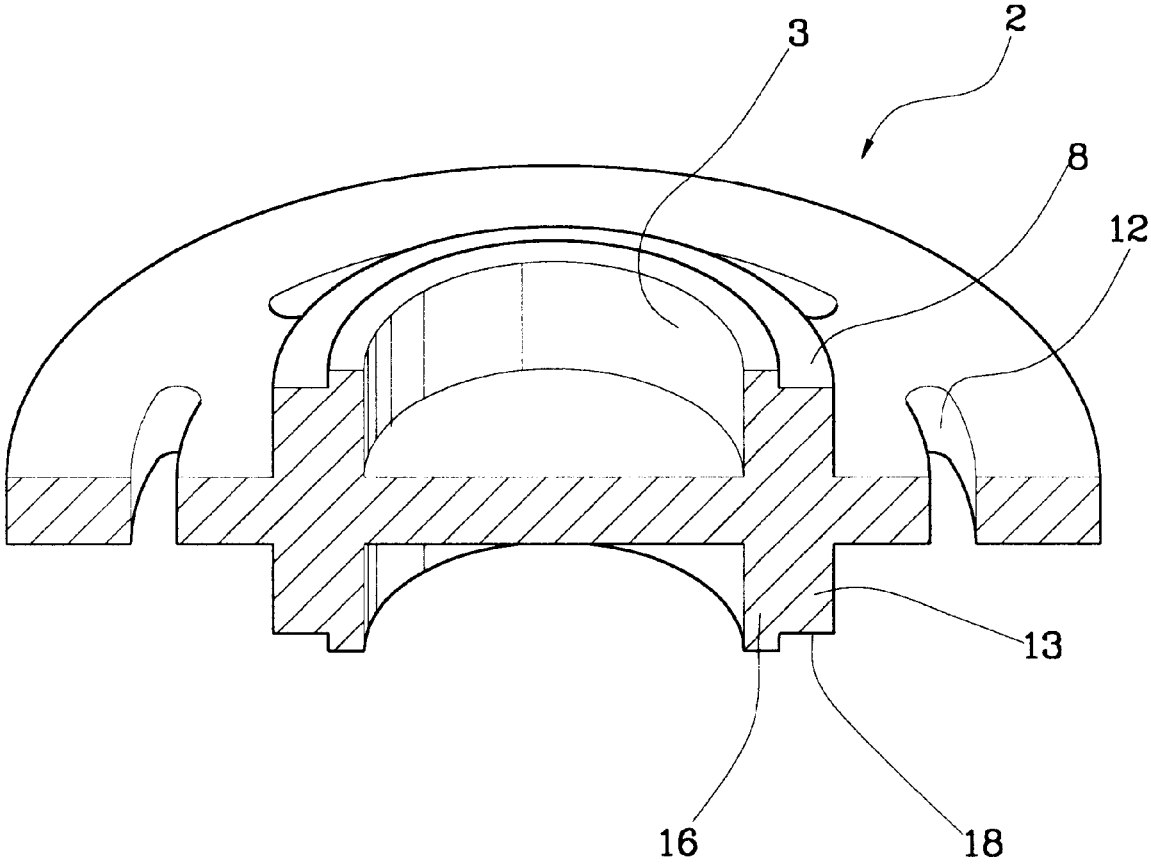
FIG. 3 is an enlarged perspective view showing the yoke of the FIG. 2 cross-sectioned.
Figure 4A:
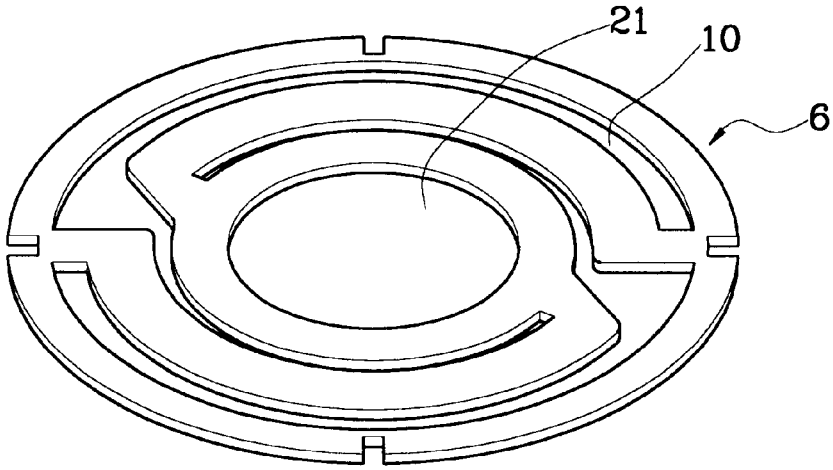
FIGS. 4*a* and 4*b* are enlarged views showing the spring of FIG. 2.
Figure 4B:
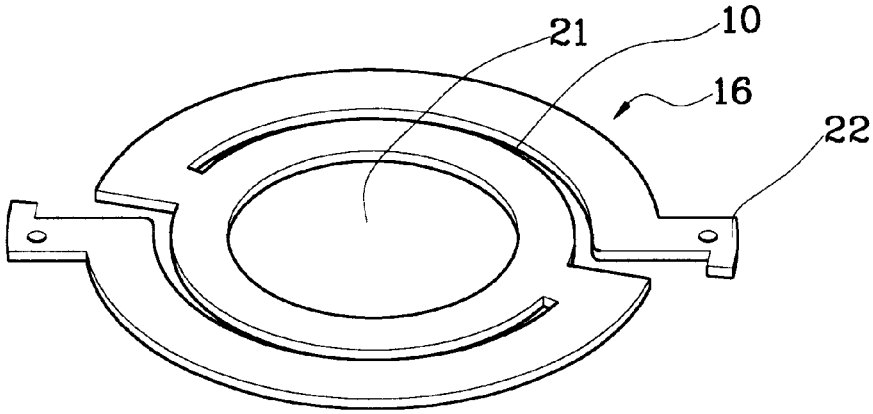

FIG. 2 is an exploded perspective view showing the signal converter according to the present invention. FIG. 3 is an enlarged perspective view showing the yoke of the FIG. 2 cross-sectioned. FIG. 4 is an enlarged view showing the spring of the FIG. 2. Referring to FIGS. 2 to 4 showing the present invention in more detail, the terminal 11 extended from the external side wall of the frame 1 is connected to the two excitation coils 7, 17 attached on the diaphragm 24 and the grill 9 in series or in parallel, and supplies a driving power such as an alternating current or pulse, etc. to the excitation coils 7, 17 respectively for generating vibration and sound.

A round-shaped yoke 2 is fixed inside the frame 1 by two springs 6, 16, and has a cylindrical-shaped protrusion 3, 13 on its top and bottom respectively, the protrusion being extended from the both sides of the yoke 2 with a certain height. A magnet 4, 14 and a plate 5, 15 are loaded inside the protrusion 3, 13 respectively inside the frame 1. The excitation coil 7, 17 is installed in a space between the protrusion 3, 13 and the magnet 4, 14, and the two magnets 4, 14 are displaced so as to contact with the yoke 2, the pole of the magnet facing the yoke 2 being a different type. In other words, if the pole of the magnet 4 contacted with the upper side of the yoke 2 is S, the pole of the magnet 14 contacted with the lower side of the yoke 2 is N. Otherwise, the reverse case is possible. If a N type pole of the magnet 4 is placed to contact with the upper side of the yoke 2, the pole of the magnet 14 contacted with the lower side of the yoke 2 is S.

The yoke 2 has a plurality of air throughs 12 along the edge around the protrusion 3 of the yoke 2, the air through being arc-shaped penetrating the body of the yoke 2 for guiding air flow. The shape and the number of the air throughs 12 can be adjusted if its function to efficiently guide air flow therethrough is satisfied.

The spring 6, 16 for fixing the yoke 2 inside the cylindrical frame 1 as illustrated in FIG. 4 is configured to have a receiving hole 21 at its center for mounting the yoke 2 and a plurality open holes 10 in arc shape around the receiving hole 21 for providing elasticity.

As shown in FIG. 4, the disk-shaped spring 6, 16 is configured such that its radius is larger than the internal radius of the frame 1 and smaller than the external radius of the frame 1. A ring-shaped external rim of the spring 6 is molded with the frame 1 integrating the spring 6 and the frame 1, and the spring 16 and the frame 1 are separately formed.

Figure 5:
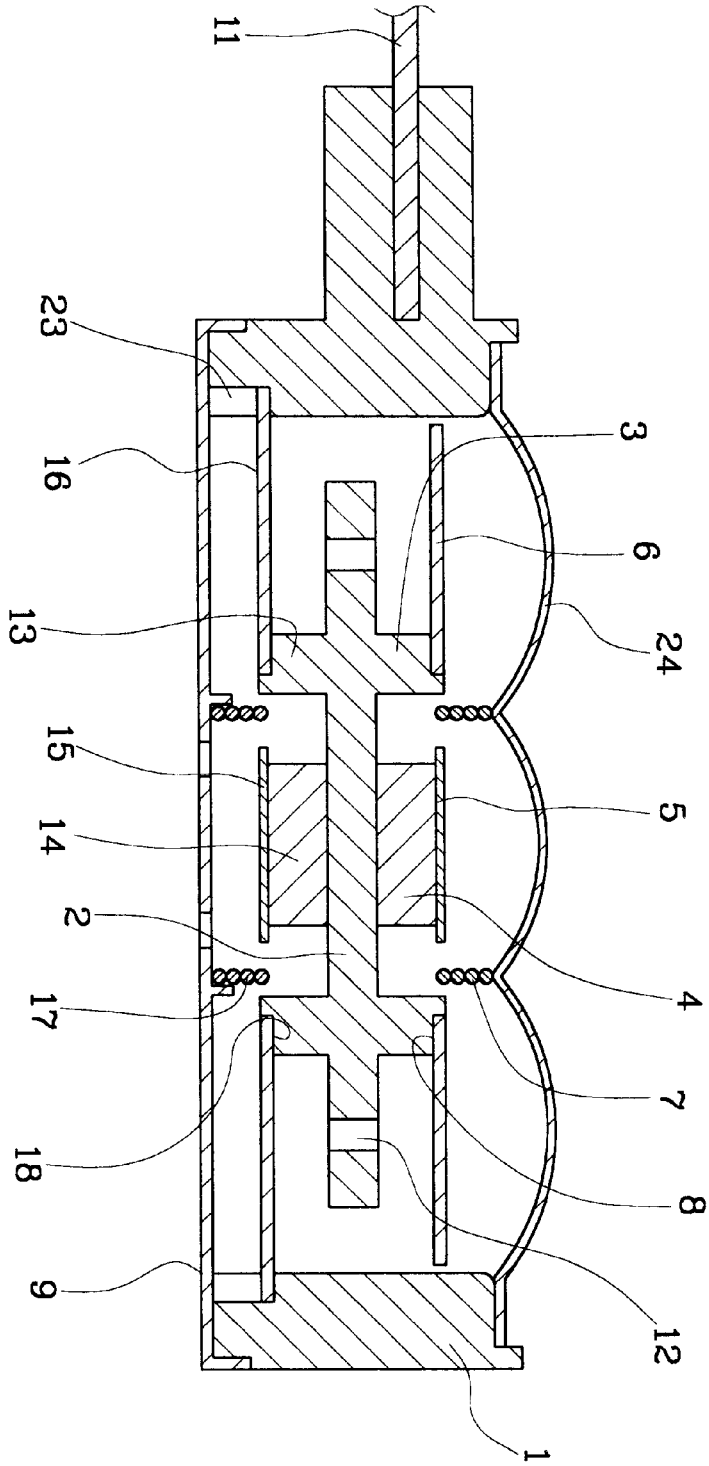
FIG. 5 is a cross-sectional view showing the signal converter of the present invention.
Figure 6:
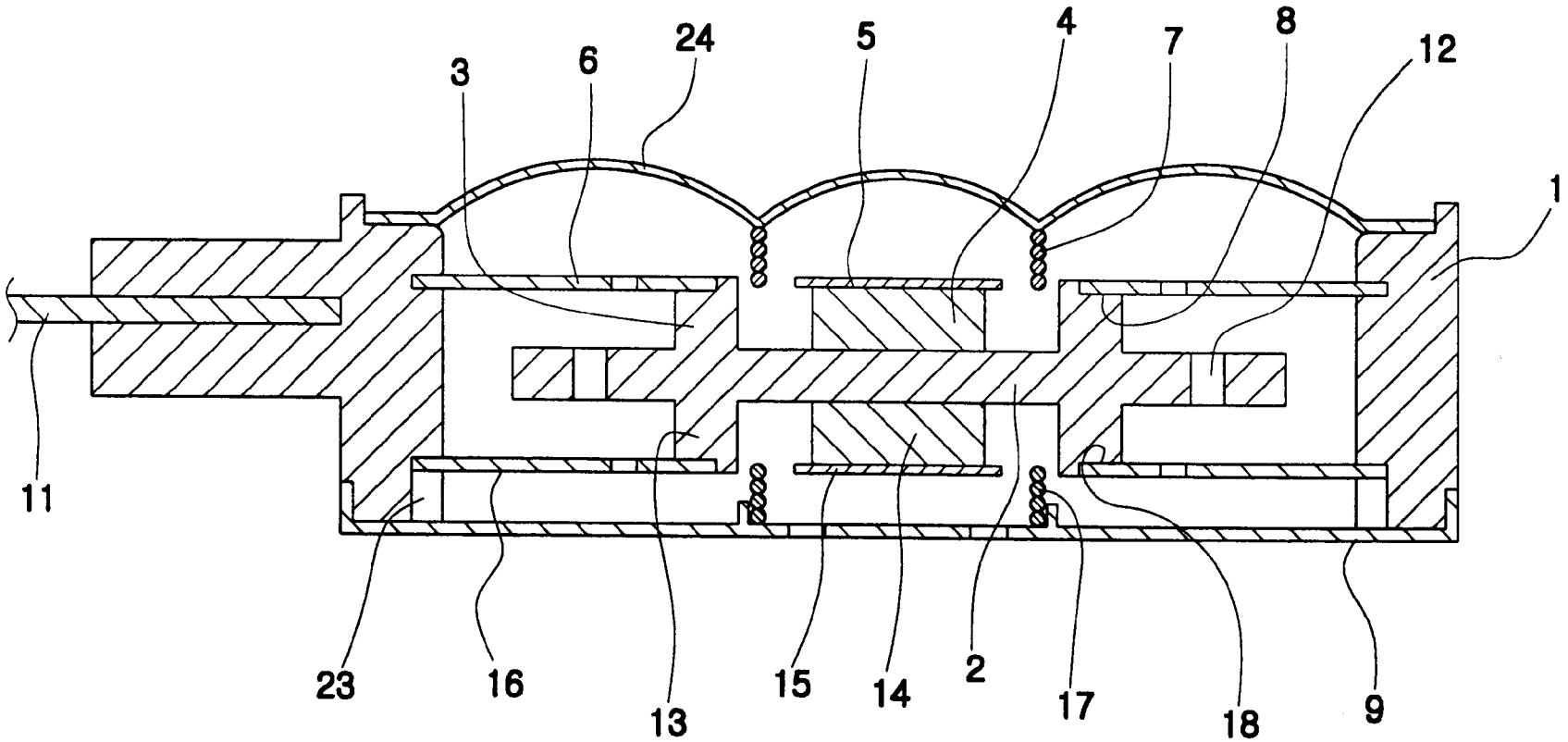
FIG. 6 is a cross-sectional view showing the signal converter with the spring coupled on the upper side of the yoke.

FIG. 5 is a cross-sectional view showing the signal converter of the present invention. A guide groove 23 is formed on the lower side of the frame 1. The yoke 2 is mounted between the spring 6 and the spring 16, and along the guide groove 23, the spring 16 and the frame 1 are coupled each other. A ring-shaped rim of the spring 16 is fixed with the upper side of the guide groove 23 by an addictive, etc. FIG. 6 shows the spring 6 integrally molded with the frame 1.

A projection 8, 18 is formed on the upper side and the lower side of the yoke 2 respectively to prevent the yoke 2 from moving right and left when the two springs 6, 16 having the receiving hole 21 are fixed with the yoke 2.

Now, the description of the operation of the signal converter configured as above is made referring to FIGS. 5 and 6.

When (+) or (−) current of driving power for generating sound of audible frequency goes through the excitation coil 7, 17 connected in parallel or in series through the terminal 11, a repulsive force is generated between the magnet 4 and the excitation coil 7, and an attractive force is generated between the magnet 14 and the excitation coil 117 so that the excitation coil 7 is lifted up with the diaphragm 24. On the contrary, if the polarity of the current through the two excitation coils 7, 17 via the terminal 11 is changed, an attractive force is generated between the magnet 4 and the excitation coil 7, and a repulsive force is generated between the magnet 14 and the excitation coil 17 so that the excitation coil 7 moves down with the diaphragm 24 so as to generate sound.

Therefore, according to the change of the polarity of the current through the excitation coil 7 connected to the diaphragm 24, and the excitation coil 17 connected to the grill 9, the excitation coil 7 moves up and down with the diaphragm 24 so as to generate a negative pressure and function as a speaker or a receiver.

Also, if (+) or (−) current of driving power having a frequency for generating vibration flows into the two excitation coils 7, 17 connected in parallel or in series through the terminal 11, a repulsive force is generated between the magnet 4 and the excitation coil 7, and an attractive force is generated between the magnet 14 and the excitation coil 17 so that the yoke 2 mounted between the two springs 6, 16 moves down.

On the contrary, if the polarity of the current through the two excitation coils 7, 17 via the terminal 11 is changed, an attractive force is generated between the magnet 4 and the excitation coil 7, and a repulsive force is generated between the magnet 14 and the excitation coil 17 so that the yoke 2, which was moved down, moves up so as to generate vibration of the signal converter comprising the yoke 2 and the frame 1, etc.

Particularly, since the two 4, 14 installed above and under the yoke 2 respectively are placed with a different pole faced each other, current flows through the excitation coil 7, 17 connected with the diaphragm 24 and the grill 9 so that an attractive force is generated between the magnet 4 and the excitation coil 7, and a repulsive force is generated between the magnet 14 and the excitation coil 17, and the yoke 2 can be vibrated more efficiently.

Also, since each of the plurality of air throughs 12 around the protrusion of the yoke 2 is shaped to go through the yoke body, the vibration of the signal converter comprising the yoke 2 and the frame 1, etc. can be maximized and the air resistance can be minimized.

Therefore, according to the present invention, power consumption can be minimized by installing the magnets such that a repulsive force or an attractive force between the magnets above and under the yoke and the excitation coil attached to the diaphragm or the grill for generating vibration or sound is directed toward the same direction.

Also, the present invention provides an advantage to decrease the power consumption of the signal converter which becomes minimized more and more fast so as to longer the usage time of a cellular phone, a PCS phone, or a notebook, etc. Comprising the signal converter thereinside.

While the foregoing specification has described a preferred embodiment of the present invention, one skilled in the art may make many modifications to the preferred embodiment without departing from the invention in its broader aspects. The appended claims therefore are intended to cover all such modifications as fall within the true scope and spirit of the invention.

What is claimed is:

1. A signal converter comprising:

a frame in a cylindrical shape;

a yoke configured to be in a round-disk shape and to have two protrusions, each protrusion outwardly extended from the center of the yoke body, and a plurality of air throughs formed around the protrusion of the yoke body, the air throughs penetrating through the yoke body for air flow;

two springs horizontally installed above and under the yoke inside the frame for providing the yoke with elasticity;

two magnets provided above and under the yoke respectively with a certain distance away from the protrusions of the yoke, the different polarity of the magnets facing each other; and two excitation coils installed respectively from a diaphragm and a grill above and under the frame to the space between the magnet and the yoke protrusion for generating magnetic force for vibration or sound with a supplied driving power of a frequency.

2. The signal converter according to claim 1, wherein the two excitation coils are connected in parallel or in series, and said driving power is supplied to the both ends of the two excitation coils connected in parallel or in series.

3. The signal converter according to claim 1, wherein a receiving hole is formed at the center of at least one of said springs for mounting the yoke, and a plurality of open holes are formed in an arc shape around the receiving hole of the spring for providing elasticity.

4. The signal converter according to claim 1, wherein the spring coupled on the upper side of the yoke is integrally molded with the frame.

* * * * *